US005146747A

United States Patent [19]

Sugiyama et al.

[11] Patent Number: 5,146,747

[45] Date of Patent: Sep. 15, 1992

[54] VALVE APPARATUS AND HYDRAULIC CIRCUIT SYSTEM

[75] Inventors: Genroku Sugiyama, Ibaraki; Toichi Hirata, Ushiku, both of Japan

[73] Assignee: Hitachi Construction Machinery Co., Ltd., Tokyo, Japan

[21] Appl. No.: 623,644

[22] PCT Filed: Aug. 16, 1990

[86] PCT No.: PCT/JP90/01045

§ 371 Date: Dec. 18, 1990

§ 102(e) Date: Dec. 18, 1990

[87] PCT Pub. No.: WO91/02902

PCT Pub. Date: Mar. 7, 1991

[30] Foreign Application Priority Data

Aug. 16, 1989 [JP] Japan ..... 1-210043

[51] Int. Cl.[5] ..... F16D 31/02; F15B 11/08

[52] U.S. Cl. ..... 60/452; 60/450; 91/446; 91/468

[58] Field of Search ..... 60/393, 445, 450, 452; 91/445, 446, 447, 468, 432, 433

[56] References Cited

U.S. PATENT DOCUMENTS

| | | | |
|---|---|---|---|
| 2,892,312 | 6/1959 | Allen et al. | 60/450 X |
| 2,971,536 | 2/1961 | Junck et al. | 91/446 X |
| 3,884,123 | 5/1975 | De Vita et al. | 91/447 |
| 3,911,942 | 10/1975 | Becker | 91/446 X |
| 3,914,939 | 10/1975 | Purdy | 60/445 X |
| 4,037,410 | 7/1977 | Jackson et al. | 60/445 |
| 4,145,958 | 3/1979 | Ille | 91/443 X |
| 4,184,410 | 1/1980 | Johnson | 91/446 X |
| 4,343,152 | 8/1982 | Habiger | 60/452 |
| 4,510,751 | 4/1985 | Jackson | 60/452 X |
| 4,617,798 | 10/1986 | Krusche et al. | 91/446 X |
| 4,617,854 | 10/1986 | Kropp | 91/517 |
| 5,067,389 | 11/1991 | St. Germain | 91/445 X |
| 5,083,430 | 1/1992 | Hirata et al. | 60/452 X |

FOREIGN PATENT DOCUMENTS

| | | |
|---|---|---|
| 60-11706 | 1/1985 | Japan . |
| 2195745 | 4/1988 | United Kingdom . |

*Primary Examiner*—Edward K. Look
*Assistant Examiner*—John Ryznic
*Attorney, Agent, or Firm*—Fay, Sharpe, Beall, Fagan, Minnich & McKee

[57] ABSTRACT

A valve apparatus (10; 10A) has at least one directional control valve (31; 31A) having a pair of variable restricting sections (43, 44) disposed between a supply passage (35) communicating with a hydraulic fluid supply source (11) and a pair of load passages (36, 37) communicating with an actuator (12). A pressure controller (32) or a pressure compensating valve (32A) is provided for holding a differential pressure across the variable restricting sections at a predetermined value. A detection line (57; 57A) is branched from a first passage (32; 86, 87) located between the pair of variable restricting sections and the pair of load passages for receiving a load pressure produced upon operation of the actuator. A check valve (59) or shuttle valve (90, 91) is provided for selecting a maximum load pressure and a control line (61, 62) introduces the selected maximum load pressure, as a control pressure, to the pressure controller or pressure compensating valve. Further, a passage (71; 86) and a check valve (73) are disposed downstream of a point where the detection line (57; 57A) is branched from the first passage (39; 86), for allowing a flow of a hydraulic fluid from the first passage toward the load passage (36) corresponding to one (43) of the variable restricting sections, but blocking off a flow of the hydraulic fluid in the reverse direction when the one variable restricting section (43) is opened.

5 Claims, 4 Drawing Sheets

VALVE APPARATUS AND HYDRAULIC CIRCUIT SYSTEM

DESCRIPTION

1. Technical Field

The present invention relates to a valve apparatus for use in hydraulic circuit systems for civil engineering and construction machines such as hydraulic excavators or cranes, and a hydraulic circuit system including the valve apparatus, and more particularly to a valve apparatus and a hydraulic circuit system in which pressure regulating means is provided for holding a differential pressure across a variable restricting section at a predetermined value, and a hydraulic fluid is distributed and supplied from a hydraulic pump to a plurality of actuators.

2. Background Art

A hydraulic excavator typical of an example of civil engineering and construction machines each equipped with a plurality of working members. The hydraulic excavator is constituted by a lower travel body, an upper swing, and a front mechanism provided on the upper swing and comprising a boom, an arm as well as a bucket. A hydraulic circuit system is also provided for driving these components. This hydraulic circuit system comprises a hydraulic pump, a plurality of actuators driven by a hydraulic fluid delivered from the hydraulic pump for operating the plurality of working members, and a valve apparatus for controlling to flow of the hydraulic fluid supplied to the plurality of actuators. The valve apparatus incorporates therein a plurality of directional control valves each equipped with a pair of variable restricting sections.

Some of this type of hydraulic circuit system includes means for controlling a pump delivery pressure, e.g., a pump regulator for controlling a pump delivery rate, so that the pump delivery pressure is held higher a fixed value than a maximum load pressure among the plurality of actuators. This is generally called a load sensing system.

Recently, various types of load sensing systems have been proposed. For example, GB 2195745A proposes a valve apparatus having a pressure controller disposed downstream of the paired variable restricting sections of each directional control valve to introduce the maximum load pressure among the plurality of actuators, as a control pressure, for holding a differential pressure across the variable restricting sections at a predetermined value. Also, JP, A, 60-11706 proposes a valve apparatus having a pressure compensating valve disposed upstream of the paired variable restricting sections of each directional control valve to introduce the maximum load pressure, as a control pressure, for holding a differential pressure across the variable restricting sections at a predetermined value. By thus holding the differential pressures across the variable restricting sections at a predetermined value, the flow rates of the hydraulic fluid passing through the respective directional control valves when the plural actuators are simultaneously driven, i.e., the flow rates supplied to the respective actuators, can be distributed at the ratios corresponding to relative proportions of input amounts (demanded flow rates) of associated operating levers, thereby permitting smooth combined operation.

However, the above conventional valve apparatus has following problems.

In the conventional valve apparatus, a detection line is branched from a line communicating with a load passage downstream of the paired variable restricting sections in order to communicate a load pressure of each actuator to the associated directional control valve. A maximum load pressure among the load pressures communicated by this and other detection lines is selected through a plurality of shuttle valves and introduced to a control line. The maximum load pressure introduced to the control line is in turn introduced, as a control pressure, to the aforesaid pressure controller or pressure compensating valve for controlling the differential pressure across the variable restricting section. Concurrently, the maximum load pressure is also introduced to the aforesaid pump regulator for controlling the pump delivery pressure so that the pump delivery pressure is held higher by a fixed value than the maximum load pressure. When all of the directional control valves are in their neutral positions, the detection lines are all communicated with a reservoir (tank) and a reservoir pressure is introduced to the control line. Further, an unloading valve is usually disposed in a pump delivery line of the load sensing system so as to hold the delivery pressure of the hydraulic pump at a predetermined minimum pressure when all of the directional control valves are in their neutral positions.

In the foregoing hydraulic circuit system, when a boom of a hydraulic excavator is lifted to raise up its front mechanism into the air and then stopped once there, for example, an actuator for the boom, i.e., a boom cylinder, produces a high holding pressure adapted to sustain the weight of the front mechanism. At this time, if all of the directional control valves are in their neutral positions, the reservoir pressure is introduced to the control line as mentioned above and the pump delivery pressure is lowered down to the predetermined minimum pressure.

Under that condition, when the directional control valve is shifted from its neutral position with an intention of further lifting the boom, the load pressure of the boom cylinder is introduced again to the detection line and hence the control line, as a control pressure, whereupon the pump regulator increases the pump delivery rate dependent on the control pressure for raising the pump delivery pressure. As a result, the hydraulic fluid is supplied at the increased flow rate to the boom cylinder through the directional control valve for implementing the intended lift of the boom.

However, because the load pressure of the boom is at the high holding pressure and this holding pressure is higher than the pressure in the detection line and hence the control line in the above operation, at the moment when the directional control valve is shifted from its neutral position, the hydraulic fluid in the load passage under the holding pressure is caused to flow into the detection line and hence the control line owing to and dependent on compressibility of oil as a working fluid, the volume of the detection line and control line, operation strokes of the shuttle valves, leakage from equipment such as the pressure controller or pressure compensating valve, etc. This leads to a fear that even though the directional control valve is shifted with an intention of further lifting the boom, the boom cylinder may be momentarily moved in the direction of contraction to lower the boom.

Moreover, the high holding pressure is directly introduced to the control line and this high pressure acts on the pump regulator in an instant, thus resulting in a fear that stable control may becomes difficult to perform, and the equipment may be damaged so that the service life may be shortened.

An object of the present invention is to provide a valve apparatus and a hydraulic circuit system including the valve apparatus which can prevent a hydraulic fluid from leaking into circuit lines, such as a detection line and a control line, and associated equipment by the presence of a holding pressure, when a directional control valve is shifted under a condition that the directional control valve is at its neutral position and the holding pressure is acting on an associated actuator.

DISCLOSURE OF THE INVENTION

To achieve the above object, the present invention provides a valve apparatus comprising at least one directional control valve having a supply passage communicating with a hydraulic fluid supply source, a pair of load passages communicating with an actuator, a pair of variable restricting sections disposed between said supply passage and said pair of load passages and formed in an axially movable valve spool in such a manner as to continuously vary the opening areas from a closed state dependent on an amount of movement of said valve spool, and a first passage located between said pair of variable restricting sections and said pair of load passages; pressure regulating means for holding a differential pressure across said variable restricting sections at a predetermined value; a detection line branched from said first passage for receiving a load pressure produced upon operation of said actuator; higher pressure selecting means for selecting a maximum load pressure among the load pressure led through said detection line and other load pressures; and a control line for introducing the maximum load pressure selected by said higher pressure selecting means, as a control pressure, to said pressure regulating means, wherein said valve apparatus further comprises first flow control means disposed downstream of a point where said detection line is branched from said first passage, for allowing a flow of a hydraulic fluid directing from said first passage toward the load passage corresponding to one of said variable restricting sections, but blocking off a flow of the hydraulic fluid in the reverse direction when said one variable restricting sections is opened.

With the provision of the above first flow control means, when the directional control valve is shifted under a condition that a holding pressure is produced to act on the actuator, the hydraulic fluid in the load passage is prevented from leaking into circuit lines such as the detection line and the control line, and associated equipment under the action of the holding pressure and, therefore, the actuator is prevented from operating in the direction not intended. Further, since the control line is not subjected to the high holding pressure in a moment, it is also possible to control the pump regulator in a stable manner and prolong the service life of the equipment.

The first flow control means is preferably incorporated in the valve spool. Also, the first flow control means preferably comprises a second passage formed in the valve spool for communicating a part of the first passage downstream of the branched point of the detection line with the load passage corresponding to one of the variable restricting sections when the one variable restricting section is opened, and a check valve disposed in the second passage for blocking off a flow of the hydraulic fluid directing from the above corresponding load passage toward the first passage.

Moreover, the valve apparatus of the present invention preferably further comprises second flow control means disposed downstream of a point where the detection line is branched from the first passage, for allowing a flow of the hydraulic fluid to flow from the first passage toward the load passage corresponding to the other variable restricting section, but blocking off a flow of the hydraulic fluid in the reverse direction when the other variable restricting sections is opened.

In addition, to achieve the above object, the present invention proposes a hydraulic circuit system comprising a hydraulic fluid supply source, at least one actuator driven by a hydraulic fluid delivered from said hydraulic fluid supply source, and the above-described valve apparatus for controlling a flow of the hydraulic fluid supplied to said actuator,

BEST MODE FOR CARRYING OUT THE INVENTION

Figure 1:
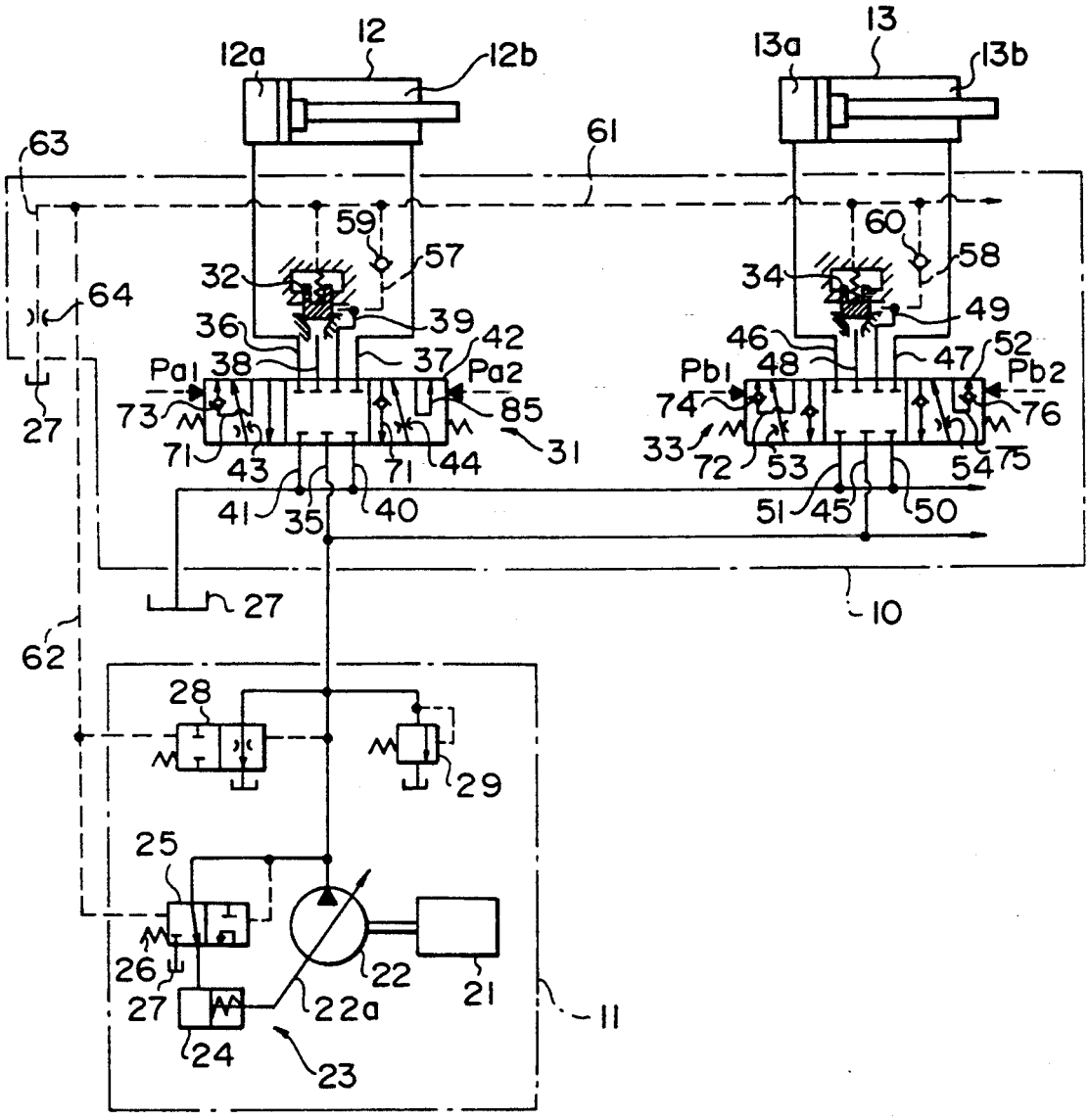
FIG. 1 is a diagrammatic view of a hydraulic circuit system including a valve apparatus according to a first embodiment of the present invention.

Hereinafter, preferred embodiments of the present invention will be described by referring to the drawings in connection with a hydraulic excavator as an example of civil engineering and construction machines.

FIRST EMBODIMENT

To begin with, a first embodiment of the present invention will be explained with reference to FIGS. 1 to 3.

CONSTITUTION

In FIG. 1, a valve apparatus according to this embodiment is denoted by reference numeral 10. The valve apparatus 10 is incorporated in a hydraulic circuit system comprising a hydraulic fluid supply source 11 and a plurality of actuators 12, 13 driven by a hydraulic fluid delivered from the hydraulic fluid supply source 11. This hydraulic circuit system is mounted on a hydraulic excavator shown in FIG. 2. The hydraulic excavator comprises a lower travel body 14, an upper swing 15, and a front mechanism 16 supported on the upper swing 15. The front mechanism 16 has a boom 17, an arm 18 and a bucket 19. The actuator 12 is a boom cylinder for driving the boom 17 of the front mechanism 16, and the actuator 13 is an arm cylinder for driving the arm 18. In addition, the bucket 19 is driven by a bucket cylinder 20, and the lower travel body 14 and the upper swing 15 are driven by associated actuators (not shown), respectively. The hydraulic circuit system of FIG. 1 can be constituted to include circuit sections necessary for supplying the hydraulic fluid to those actuators as well.

As shown in FIG. 1, the hydraulic fluid supply source 11 has a hydraulic pump 22 of variable displacement type driven by a prime mover 21, and a pump regulator 23 of load sensing type for controlling a flow rate of the hydraulic fluid delivered from the hydraulic pump 22. The pump regulator 23 comprises a working cylinder 24 coupled to a swash plate 22*a* of the hydraulic pump 22 for driving the swash plate 22*a*, and a control valve 25 for controlling operation of the working cylinder 24. The control valve 25 has a pair of drive parts in opposite relation, one of which is subjected to a delivery pressure of the hydraulic pump 22 and the other of which is subjected to a control pressure (described later). The control valve 25 also has a spring 26 for setting a target value of the load sensing differential pressure.

When the control pressure introduced to the control valve 25 rises, the control valve 25 is driven rightwardly on the drawing, whereby the hydraulic fluid is supplied to a chamber of the working cylinder 24 on the head side to increase a tilting angle of the swash plate 22*a*. On the contrary, when the control pressure lowers, the control valve 25 is driven leftwardly on the drawing, whereby the hydraulic fluid in the head-side chamber of the working cylinder 24 is discharged into a reservoir (tank) 27 to decrease a tilting angle of the swash plate 22*a*. As a result, the pump delivery rate is controlled so that the differential pressure between the pump delivery pressure and a maximum load pressure is held at the target value set by the spring 26.

The hydraulic fluid supply source 11 further has an unloading valve 28 which is operated in response to the differential pressure between the pump delivery pressure and the maximum load pressure for not only limiting a transient rise of the differential pressure, but also holding the pump delivery pressure at a specified value in a neutral condition of the valve apparatus 10, and a relief value 29 for specifying the highest value of the pump delivery pressure.

Meanwhile, the valve apparatus 10 according to this embodiment is provided with a directional control valve 31 and a pressure controller 32 for controlling a flow of the hydraulic fluid supplied to the boom cylinder 12, and a directional control valve 33 and a pressure controller 34 for controlling a flow of the hydraulic fluid supplied to the arm cylinder 13.

The directional control valve 31 comprises a supply passage 35 communicating with the hydraulic fluid supply source 11, a pair of load passages 36, 37 communicating with the head side 12*a* and the rod side 12*b* of the boom cylinder 12, respectively, intermediate passages 38, 39 capable of selectively communicating with the pair of load passages 36, 37, a pair of discharge passages 40, 41 communicating with the reservoir 27, and a valve spool 42 movable in the axial direction to selectively change over the communication between the above passages. The valve spool 42 is formed in a passage communicating between the supply passage 35 and the intermediate passage 38 with a pair of variable restricting sections 43, 44 which can continuously vary their opening areas from a closed state to a certain preset degree in accordance with an amount of movement of the valve spool 42. Depending on the opening areas of the variable restricting sections 43, 44, the flow rates of the hydraulic fluid supplied to the head side 12*a* and the rod side 12*b* of the boom cylinder 12 are respectively regulated. The opposite ends of the valve spool 42 are subjected to pilot pressures Pa1, Pa2 led from pilot valves (not shown), so that the valve spool 42 is shifted in response to the pilot pressures.

The directional control valve 33 is constituted in a like manner and comprises a supply passage 45, a pair of load passages 46, 47, intermediate passages 48, 49, a pair of discharge passages 50, 51, a valve spool 52, and a pair of variable restricting sections 53, 54. The load passage 46 is communicated with the head side 12*a* of the arm cylinder 13, and the load passage 47 is communicated with the rod side 12*b* of the arm cylinder 13, respectively. Also, the opposite ends of the valve spool 52 are subjected to pilot pressures Pb1, Pb2 led from pilot valves (not shown), so that the valve spool 52 is shifted in response to the pilot pressures.

The aforesaid pressure controller 32 is disposed between the intermediate passages 38 and 39, i.e., between the variable restricting sections 43, 44 and the load passages 36, 37, such that outlet pressures of the variable restricting sections 43, 44 act in the valve-opening direction and the control pressure (described later) acts in the valve-closing direction, thereby holding a differential pressure across each of the variable restricting sections 43, 44 at a predetermined value. The pressure controller 34 is disposed between the intermediate passages 48 and 49, i.e., between the variable restricting sections 53, 54 and the load passages 46, 47, such that outlet pressures of the variable restricting sections 43, 44 act in the valve-opening direction and the control pressure (described later) acts in the valve-closing direction, thereby holding a differential pressure across each of the variable restricting sections 53, 54 at a predetermined value.

The valve apparatus 10 further includes detection lines 57, 58 branched from the intermediate passages 39, 49 for receiving or introducing the load pressures developed upon operations of the boom cylinder 12 and the arm cylinder 13, respectively; higher pressure selector means for selecting the higher one of the load pressures introduced from the detection lines 57, 58, i.e., the maximum load pressure, for example, check valves 59, 60 disposed in the detection lines 57, 58 for blocking off to flow of the hydraulic fluid directed to the intermediate passages 39, 49, respectively; control lines 61, 62 for introducing the maximum load pressure selected by the check valves 59, 60, as the control pressure, to the pressure controllers 32, 34, the control valve 25 of the pump regulator 23, and the unloading valve 28; as well as a line 63 and a restrictor 64 for lowering pressures in the control lines 61, 62 down to a pressure of the reservoir 27 when the directional control valves 31, 33 are returned to their neutral positions.

In this embodiment, the valve spools 42, 52 are also formed with connection passages 71, 72 for cutting off the communication between the intermediate passages 39, 49 and the corresponding load passages 36, 46 when the variable restricting sections 43, 53 are closed, and for communicating the intermediate passages 39, 49 with the corresponding load passages 36, 46 when the variable restricting sections 43, 53 are opened. Disposed in the connection passages 71, 72 are check valves 73, 74 that prevent flow of the hydraulic fluid from the load passages 36, 46 toward the intermediate passages 39, 49, respectively.

In the directional control valve 33 associated with the arm cylinder 13, the valve spool 52 is further formed with a connection passage 75 for cutting off the communication between the intermediate passage 49 and the corresponding load passage 47 when the variable restricting section 54 is closed, and for communicating the intermediate passage 49 with the corresponding load passage 47 when the variable restricting section 54 is opened. Disposed in the connection passage 75 is a check valve 76 to prevent hydraulic fluid from flowing from the load passage 47 toward the intermediate passage 49.

Figure 3:
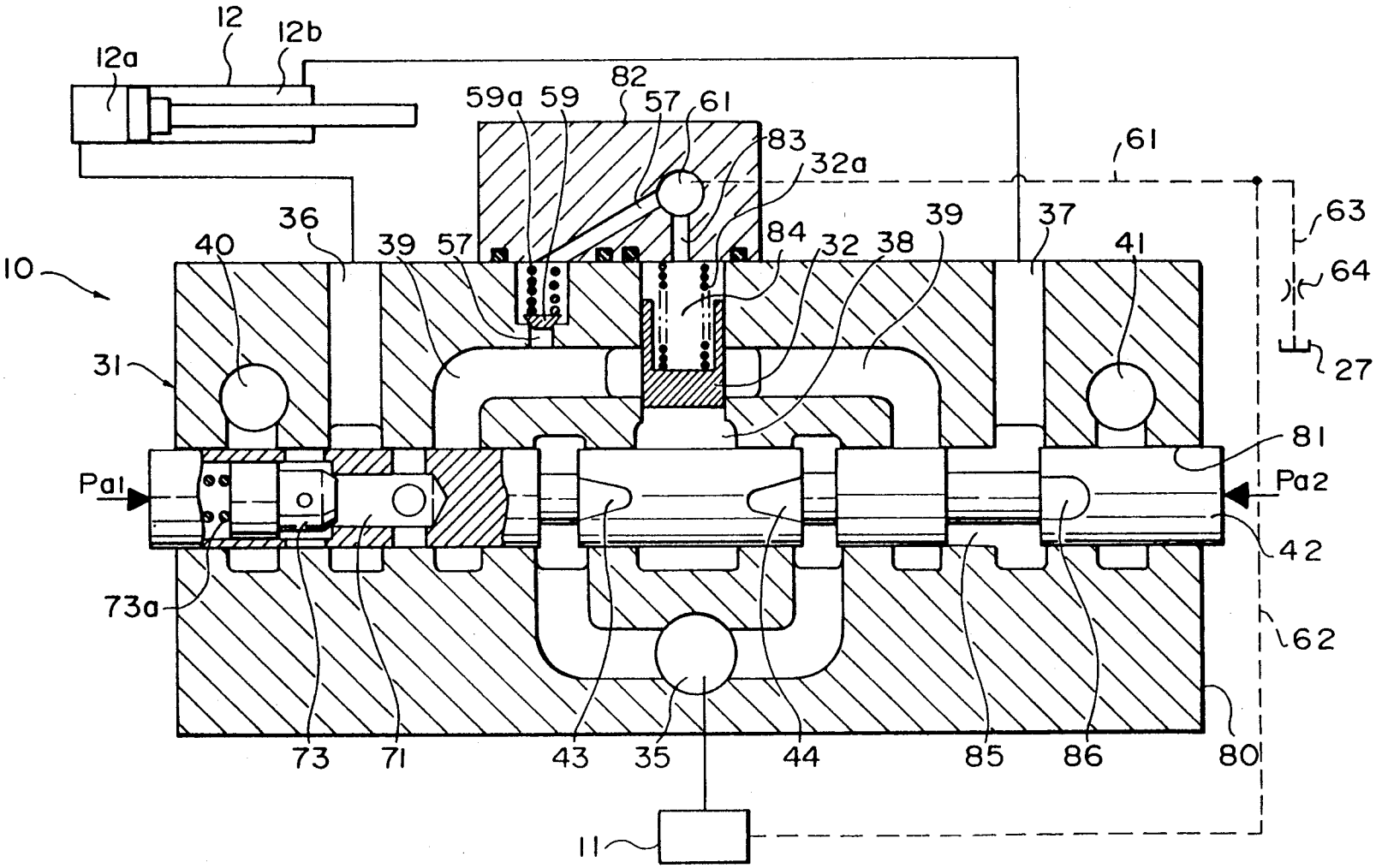
FIG. 3 is a sectional view showing the structure of the valve apparatus.

FIG. 3 shows the hardware arrangement of a section of the directional control valve 31 and the pressure controller 32 in the valve apparatus 10. The valve apparatus 10 has a valve block 80 in which there are formed parts of the aforesaid passages 35–41 and detection lines 57. The valve spool 42 is disposed to be axially slidable in a bore 81 formed through the valve block 80. The pressure controller 32 and the check valves 59, 73 are urged by weak springs 32*a*, 59*a*, 73*a* in the valve-closing direction, respectively. The variable restricting sections 43, 44 are each defined around the valve spool 42 in the form of plural notches.

When the valve spool 42 is moved rightwardly from an illustrated neutral position, the variable restricting section 43 is opened and the intermediate passage 39 is communicated with the load passage 36 through the connection passage 71 and the check valve 73 within the valve spool 42. At the same time, the other load passage 37 is communicated with the discharge passage 41 through an annular recess 85 and notches 86 both formed around the valve spool 42. Conversely, when the valve spool 42 is moved leftwardly from the illustrated position, the variable restricting section 44 is opened and the intermediate passage 39 is communicated with the load passage 37 through the annular recess 85 which functions as a connection passage. At the same time, the load passage 36 is communicated with the discharge passage 40 through the connection passage 71 and the check valve 73.

In addition, the valve apparatus 10 has a small valve block 82 integrally combined with the valve block 80. In the small valve block 82, there are formed the rest of the detection line 17 and a part of the control line 61. This part of the control line 61 is communicated via a passage 83 with a chamber 84 in which the spring 32*a* for the pressure controller 32 is accommodated. By thus forming the control line 61 in two parts respectively in the main valve block 80 and the separate small valve block 82, the control line 61 can be easily manufactured.

The hardware arrangement of a section of the directional control valve 33 and the pressure controller 34 are substantially the same as that shown in FIG. 3, except that the opposite end sides of the valve spool 52 are each formed to have the arrangement corresponding to the connection passage 71 and the check valve 73.

OPERATION AND ADVANTAGEOUS EFFECT

Operation of the first embodiment thus constituted will be described below.

In the hydraulic circuit system of this embodiment, when the valve spools 42, 52 of the directional control valves 31, 33 being driven to shift, the delivery pressure of the hydraulic pump 22 is introduced to the supply passages 35, 45, the variable restricting sections 43, 53 or 44 or 54 and the intermediate passages 38, 48, whereby the pressure controllers 32, 34 are pushed upwardly in FIG. 1, respectively. The hydraulic fluid having passed through the pressure controllers 32, 34 is supplied to the boom cylinder 12 and the arm cylinder 13 via the intermediate passages 39, 49, the connection passages 71, 72 and the load passages 36, 46, or the intermediate passages 39, 49, the connection passages 85, 75 and the load passages 37, 47, respectively, whereby the boom cylinder 12 and the arm cylinder 13 are simultaneously driven.

During that combined operation, the load pressure of the boom cylinder 12 is introduced to the intermediate passage 39 via the load passage 36 or 37, and then to the control line 61 via the detection line 57 and the check valve 59. On the other hand, the load pressure of the arm cylinder 13 is introduced to the intermediate passage 49 via the load passage 46 or 47, and then to the control line 61 via the detection line 58 and the check valve 60. Eventually, the higher one of the load pressures of the boom cylinder 12 and the arm cylinder 13, i.e., the maximum load pressure, is taken as the control pressure in the control line 61. This control pressure is then applied to the pressure controllers 32, 34, whereby the pressure controllers 32, 34 are lowered from the aforesaid ascended state against the supply pressure from the hydraulic pump 22. As a result, pressures in the intermediate passages 38, 48, i.e., the outlet pressures of the variable restricting section 43, 53 or 44, 54, are increased so that the pressures in the intermediate passages 38, 48 are controlled to become equal to each other.

Here, inlet pressures of the variable restricting sections 43, 53 or 44, 54 of the valve spools 42, 52 are given by the pressures in the supply passages 35, 45, i.e., the delivery pressure of the hydraulic pump 22, and hence are equal to each other. Also, the inlet pressures of the variable restricting section 43, 53 or 44, 54, i.e., the pressures in the intermediate passages 38, 48, are equal to each other as mentioned above. Accordingly, the respective differential pressures across the valve spools 42, 52 are always equal to each other. At the same time, the control pressure in the control line 61, i.e., the maximum load pressure between the boom cylinder 12 and the arm cylinder 13, is introduced to one drive part of the control valve 25 of the pump regulator 23 via the control line 62, while the pump delivery pressure is introduced to the other drive part of the control valve 25, allowing the control valve 25 to be controlled based on the balance of a force of the spring 26 with a force dependent on the differential pressure between the pump delivery pressure and the maximum load pressure. The delivery rate of the hydraulic pump 22 is thereby controlled so that the differential pressure between the pump delivery pressure and the maximum load pressure is held coincident with the target value set by the spring 26, as explained above.

As a result of the valve apparatus 10 and the hydraulic pump 22 being thus controlled, the hydraulic fluid is supplied to the boom cylinder 12 and the arm cylinder 13 at the flow rates dependent on the respective restricting amounts, i.e., opening areas, of the variable restricting sections 43, 53 or 44, 54 corresponding to the stroke amounts of the valve spools 42, 52. Therefore, the boom cylinder 12 and the arm cylinder 13 can be simultaneously driven in a stable manner without affecting each other on account of their load fluctuations.

Further, in this first embodiment, the check valve 73 is disposed in the connection passage 71 within the valve spool 42 of the directional control valve 31 associated with the boom cylinder 12, and the check valves 74, 76 are disposed in the connection passages 72, 75 within the valve spool 52 of the directional control valve 33 associated with the arm cylinder 13, as explained above. This arrangement allows the following operation.

Let it be assumed that the boom 17 is lifted to raise up the front mechanism 16 into the air and then it is stopped once there, as one example of a working mode. Under this condition, a high holding pressure enough to sustain the weight of the front mechanism is produced in the head side 12*a* of the boom cylinder 12. This holding pressure is supposed to be about 100 kg/cm$^2$, for instance. At this time, the directional control valves 31, 33 are returned to their neutral positions to cut off the intermediate passages 38, 39 and 48, 49 from the load passages 36, 37 and 46, 47, so that the reservoir pressure is introduced to the control lines 61, 62 via the line 63 and the restrictor 64. As a result, the swash plate 22*a* of the hydraulic pump 22 is controlled to be held at a minimum tilting position, and the pump delivery pressure is held at a low level by the unloading valve 28, e.g., about 20 kg/cm$^2$, for preventing energy loss during the neutral condition.

Under that condition, when the valve spool 42 of the directional control valve 31 is shifted to a left-hand position in FIG. 1 for supplying the hydraulic fluid to the head side 12*a* of the boom cylinder 12 with an intention of further lifting the boom, the variable restricting section 43 is opened and so is the connection passage 71. At this time, however, the pump delivery pressure is low on the order of 20 kg/cm$^2$, while the holding pressure of the boom cylinder 12 is as high as 100 kg/cm$^2$, as mentioned above. Accordingly, the hydraulic fluid will not be supplied to the boom cylinder 12 until the pump delivery pressure exceeds the holding pressure as the delivery rate of the hydraulic pump 22 increases.

Now, if the check valve 73 were not disposed in the connection passage 71, the aforesaid holding pressure of 100 kg/cm$^2$ produced in the load passage 36 would cause the hydraulic fluid in the load passage 36 to flow into the detection line 57, the check valve 59 and the control lines 61, 62 owing to and dependent on compressibility of oil as a working fluid, the volume of the detection line 57 and control lines 61, 62, an operation stroke of the check valve 59, and leakage from hydraulic equipment such as the pressure controllers 32, 34 and the restrictor 64. Therefore, even though the directional control valve is shifted with an intention of further lifting the boom, the boom cylinder 12 would be momentarily moved in the direction of contraction to lower the boom 17. Moreover, because the pressure in the control line 62 is raised from the reservoir pressure up to the holding pressure of 100 kg/cm$^2$ in an instant and the control valve 25 of the pump regulator 23 is momentarily subjected to this high pressure, stable control would become difficult to perform. Also, because of the large load acting on the equipment in an instant, there might occur a fear of shortening the service life.

In this first embodiment, because the check valve 73 is disposed in the connection passage 71 for blocking off a flow of the hydraulic fluid in the load passage 36 toward the intermediate passage 39, the hydraulic fluid in the load passage 36 is prevented from flowing out into the detection line 57, the check valve 59 and the control lines 61, 62, when the valve spool 42 is shifted in such a way. Consequently, the movement of the boom cylinder 12 in the direction of contraction is avoided to positively prevent a drop of the boom 17.

Under the condition that the hydraulic fluid in the load passage 36 for the boom cylinder 12 is kept from flowing out by the check valve 73, as mentioned above, the 20 kg/cm$^2$ delivery pressure of the hydraulic pump 22 is transmitted, upon opening of the variable restricting section 43, to the control valve 25 of the pump regulator 23 via the pressure controller 32, the detection line 57, the check valve 59 and the control lines 61, 62. Thus, the pump delivery pressure and the control pressure both acting on the pump regulator 23 are equal to each other at 20 kg/cm$^2$. From this condition, the pump regulator 23 starts increasing the delivery rate of the hydraulic pump 22 in order to raise the pump delivery pressure. Accordingly, the pump regulator 23 is subjected to a pressure sufficiently lower than the holding pressure of the boom 12, making it possible to control the pump delivery rate in a stable manner. In addition, no large load acts on the pump regulator 23 in a moment, making it also possible to prevent damages of the equipment and prolong the service life.

When the delivery rate of the hydraulic pump 22 is increased and the pump delivery pressure exceeds 100 kg/cm$^2$, the hydraulic fluid is now supplied to the load passage 36 and the head side 12*a* of the boom cylinder 12 via the intermediate passage 39, the connection passage 71 and the check valve 73. The boom cylinder 12 is thereby moved in the direction of extension to make the boom 17 start lifting again.

Further, the hydraulic pump 22 continues to increase its delivery rate until the differential pressure across the variable restricting section 43, which is produced upon the hydraulic fluid passing therethrough, becomes equal to a pressure, e.g., 15 kg/cm$^2$, set by the pressure controller 32. At the time when that differential pressure reaches 15 kg/cm$^2$, the flow rate of the hydraulic fluid supplied to the head side 12*a* of the boom cylinder 12 becomes equal to the flow rate dependent on the opening area of the variable restricting section 43. With the opening area set constant, the hydraulic fluid is supplied to the head side 12*a* at the constant flow rate, whereby the boom cylinder 12 is moved in the direction of extension to lift the boom 17 at the same rate.

Figure 2:
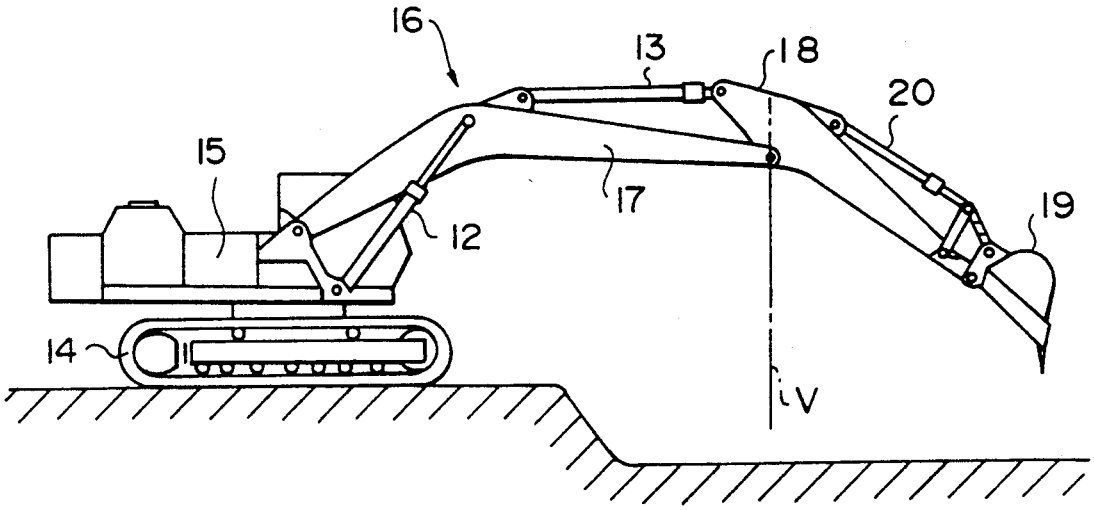
FIG. 2 is a side view of a hydraulic excavator mounting thereon the hydraulic circuit system.

While the above explanation is concerned with the case of holding the front mechanism 16 at the position shown in FIG. 2 and further lifting the boom 17, it is also equally applicable to the case of further lifting the arm 18 from a similar position. More specifically, when the front mechanism 16 is stopped at the position shown in FIG. 2, a holding pressure on the order of 70 kg/cm$^2$, for example, is produced in the rod side 13*b* of the arm cylinder 13. Accordingly, when the valve spool 52 of the directional control valve 33 is shifted to a right-hand position in FIG. 1 with an intention of further lifting the arm 18 from the above condition, the hydraulic fluid in the load passage 47 would flow into the detection line 58, the check valve 60 and the control lines 61, 62 at the moment of the shifting if the check valve 75 were not disposed in the connection passage 75 of the valve spool 52. In this embodiment, however, since the check valve 76 is disposed in the connection passage 75, the hydraulic fluid in the load passage 47 is prevented from flowing toward the intermediate passage 49, and the foregoing flow-out of the hydraulic fluid upon shifting of the valve spool 52 is prevented with certainty. This makes it possible to prevent not only an extension of the arm cylinder 13 to lower the arm 18, but also a resultant drop of the arm 18, at the moment when the valve spool 52 is shifted. Further, since the control line 62 is kept from being subjected to the high holding pressure for a moment, the pump regulator 23 can be controlled in a stable manner, which reduces a probability of damaging the equipment and prolonging its service life.

Furthermore, in the case of the front mechanism 16 being stopped at the position shown in FIG. 2, the holding pressure is produced in the rod side 13*b* of the arm cylinder 13 as mentioned above. But, in the case the arm 18 is turned downwardly (clockwise) from the position of FIG. 2 and the front mechanism 16 is stopped at a position where the bucket 19 is beyond a vertical line V, the holding pressure is produced in the head side 13*a* of the arm cylinder 13. Accordingly, when the valve spool 52 of the directional control valve 33 is shifted to a leftward position in FIG. 1 with an intention of further lifting the arm 18 from the above position toward the operator in a cab, the hydraulic fluid in the load passage 46 is prevented from flowing into the detection line 58 and the control lines 61, 62 under the holding pressure, because of the check valve 74 being disposed in the connection passage 72 of the valve spool 52. This can provide the advantageous effect such as preventing a drop of the arm 18 in a like manner to the above case.

As described above, at the moment when the valve spool 42 or 52 is shifted with an intention of lifting the boom or the arm under a condition that the holding pressure is being produced in the load passage(s) 36 or 46, 47, the check valve(s) 73 or 74, 76 serve to prevent the hydraulic fluid in the load passage(s) 36 or 46, 47 from flowing out therefrom, resulting in positive prevention of a drop of the boom 17 or the arm 18. Also, since the high holding pressure is not directly introduced to the control line 62, it is possible to perform stable control of the pump regulator 23, thus reducing a probability of damaging the equipment, and prolonging its service life.

SECOND EMBODIMENT

A second embodiment of the present invention will be described with reference to FIG. 4. This embodiment adopts a different valve structure as pressure regulating means for controlling the differential pressure across the variable restricting section of the directional control valve. The remaining arrangement is substantially the same as that of the first embodiment. In the drawing, the identical components to those shown in FIG. 1 are designated by the same reference characters.

Figure 4:
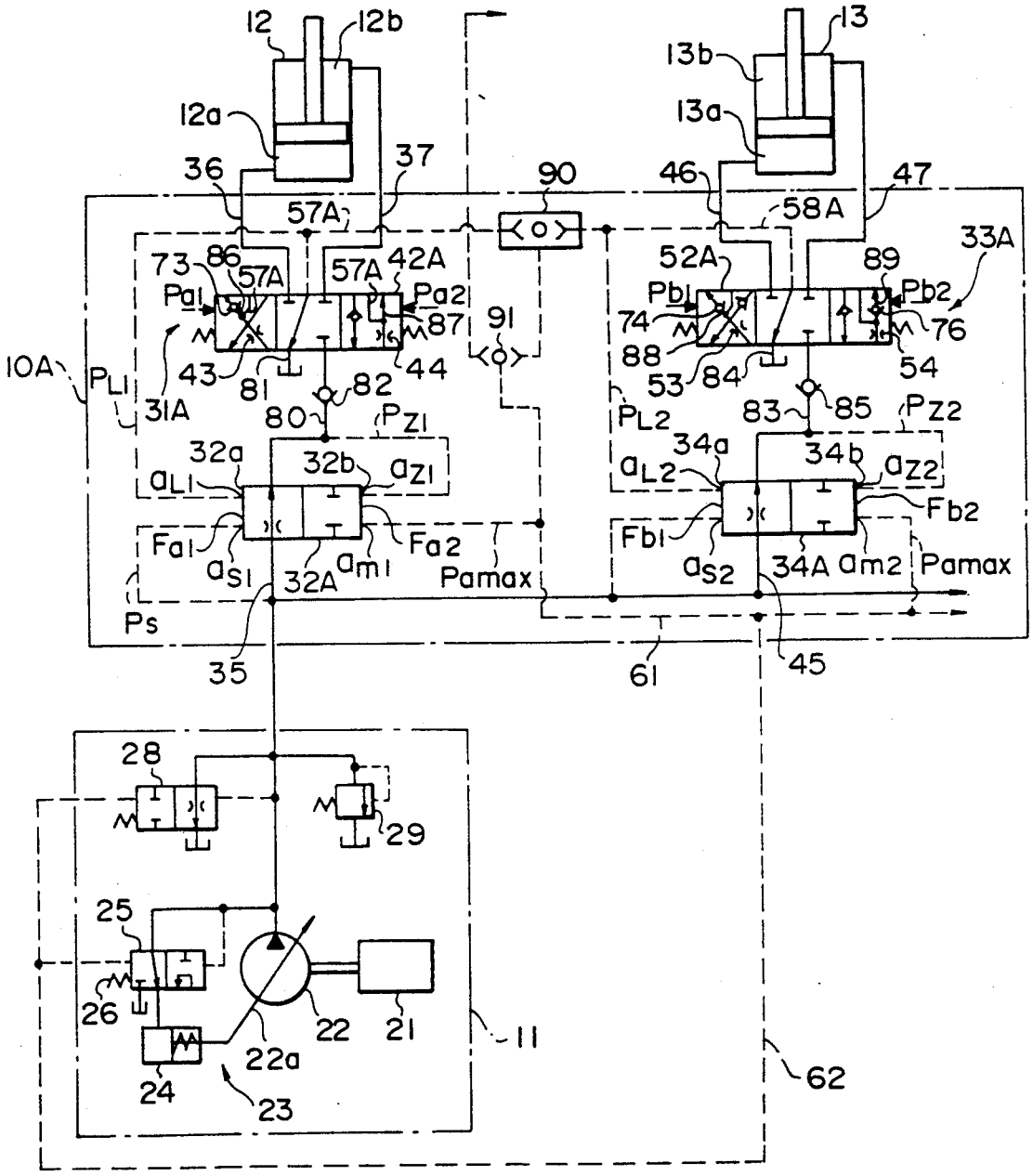
FIG. 4 is a diagrammatic view of a hydraulic circuit system including a valve apparatus according to a second embodiment of the present invention.

In FIG. 4, a valve apparatus 10A of this embodiment comprises a directional control valve 31A for controlling the flow rate and direction of the hydraulic fluid supplied to a boom cylinder 12, a pressure compensating valve 32A disposed upstream of the directional control valve 31A for controlling a differential pressure across the directional control valve 31A, a directional control valve 33A for controlling the flow rate and direction of the hydraulic fluid supplied to an arm cylinder 13, and a pressure compensating valve 34A disposed upstream of the directional control valve 33A for controlling a differential pressure across the directional control valve 33A.

The directional control valve 31A comprises an intermediate passage 80 communicated with a supply passage 35 through the pressure compensating valve 32A, a pair of load passages 36, 37 communicating with the head side 12*a* and the rod side 12*b* of the boom cylinder 12, respectively, a discharge passage 81 communicating with a reservoir 27, and a valve spool 42A movable in the axial direction to selectively change over the communication between the above passages. The valve spool 42A is formed in a passage communicating between the intermediate passage 80 and the load passages 36, 37 with a pair of variable restricting sections 43, 44 which can continuously vary their opening areas from a closed state to a certain preset degree in accordance with an amount of movement of the valve spool 42A. Depending on the opening areas of the variable restricting sections 43, 44, the flow rates of the hydraulic fluid supplied to the head side 12*a* and the rod side 12*b* of the boom cylinder 12 are respectively regulated. Further, a check valve 82 is disposed in the intermediate passage 80 to prevent a flow of the hydraulic fluid from the valve spool 42A toward the pressure compensating valve 32A.

The directional control valve 33A is constituted in a like manner and comprises an intermediate passage 83, a pair of load passages 46, 47, a discharge passage 84, a valve spool 52A, a pair of variable restricting sections 53, 54, and a check valve 85.

The valve apparatus 10A also includes a detection line 57A branched from passages 86, 87 located between the variable restricting sections 43, 44 of the valve spool 42A and the pair of load passages 36, 37 for receiving or introducing the load pressure of the boom cylinder 12; a detection line 58A branched from passages 88, 89 located between the variable restricting sections 53, 54 of the valve spool 52A and the pair of load passages 46, 47 for receiving or introducing the load pressure of the arm cylinder 13; shuttle valves 90, 91 for selecting the highest one of the load pressures introduced from the detection lines 57A, 58A and the load pressures of other actuators (not shown), i.e., the maximum load pressure; as well as control lines 61, 62 for introducing the selected maximum load pressure, as a control pressure, to the pressure compensating valves 32A, 34A, a control valve 25 of a pump regulator 23, and an unloading valve 28.

The pressure compensating valve 32A is disposed between the supply passage 35 and the intermediate passage 80, whereas the pressure compensating valve 34A is disposed between the supply passage 45 and the intermediate passage 83.

The pressure compensating valve 32A has one drive part 32*a* which is subjected to a control force Fa1 given by both a pressure upstream of the pressure compensating valve 32A, i.e., a pump delivery pressure Ps, and a load pressure PL1 of the boom cylinder 12 in the direction of opening of the pressure compensating valve 32A, and the other drive part 32*b* which is subjected to a control force Fa2 given by both a pressure downstream of the pressure compensating valve 32A, i.e., an inlet pressure PZ1 of the valve spool 42A, and a pressure in the control line 61, i.e., a maximum load pressure Pamax in the direction of closing of the pressure compensating valve 32A. Likewise, the pressure compensating valve 34A has one drive part 34*a* which is subjected to a control force Fb1 given by both the pump delivery pressure Ps and a load pressure PL2 of the arm cylinder 13 in the direction of opening of the pressure compensating valve 34A, and the other drive part 34*b* which is subjected to a control force Fb2 given by both a pressure downstream of the pressure compensating valve 34A, i.e., an inlet pressure PZ2 of the valve spool 52A, and the maximum load pressure Pamax in the direction of closing of the pressure compensating valve 34A.

In the valve spool 42A constituting the directional control valve 31A, there is disposed a check valve 73 downstream of a point where the passage 86 is branched from the detection line 57A, for blocking off a flow of the hydraulic fluid from the load passage 36 toward the variable restricting section 43. Likewise, in the valve spool 52A constituting the directional control valve 33A, there are disposed check valves 74, 76 downstream of a point where the passages 88, 89 are branched from the detection line 58A, for blocking off flows of the hydraulic fluid from the load passages 46, 47 toward the variable restricting sections 53, 54.

In this second embodiment, let it be assumed that when the boom cylinder 12 and the arm cylinder 13 having different drive pressures are simultaneously driven, for example, when a differential pressure between the pump pressure Ps and the maximum load pressure Pamax, i.e., a load sensing differential pressure is ΔPLS, the pressure receiving or bearing area of the drive part of the pressure compensating valve 32A subjected to the load pressure PL1 is aL1, the pressure receiving area of the drive part thereof subjected to the load pressure PZ1 is aZ1, the pressure receiving area of the drive part thereof subjected to the pump pressure Ps is as1, the pressure receiving area of the drive part thereof subjected to the maximum load pressure Pamax is am1, the pressure receiving area of the drive part of the pressure compensating valve 34A subjected to the load pressure PL2 is aL2, the pressure receiving area of the drive part thereof subjected to the load pressure PZ2 is aZ2, the pressure receiving area of the drive part thereof subjected to the pump pressure Ps is as2, and the pressure receiving area of the drive part thereof subjected to the maximum load pressure Pamax is am2. Assuming also, for convenience, that;

$$\begin{aligned} aL1 &= aZ1 = as1 = am1 \\ &= aL2 = aZ2 = as2 = am2 \end{aligned}$$

the following equation holds from a balance of the forces acting on the drive parts of the pressure compensating valve 32A:

$$PL1 \cdot aL1 + Ps \cdot as1 = Pz1 \cdot az1 + Pamax \cdot am1 \quad (1)$$

Here, in consideration of the relationship of aL1=as1=aZ1=am1 and the assumption that the differential pressure between the pump pressure Ps and the maximum load pressure Pamax is ΔPLS, the differential pressure PZ1−PL1 across the valve spool 42A for the boom cylinder 12 is expressed by:

$$PZ1 - PL1 = Ps - Pamax = \Delta PLS \quad (2)$$

Likewise, the following equation holds from a balance of the forces acting on the drive parts of the pressure compensating valve 34A:

$$PL2 \cdot aL2 + Ps \cdot as2 = Pz2 \cdot az2 + Pamax \cdot am2 \quad (3)$$

Here, in consideration of the relationship of aL2=as2=aZ2=am2, the differential pressure PZ2−PL2 across the valve spool 52A for the arm cylinder 13 is expressed by:

$$PZ2 - PL2 = Ps - Pamax = \Delta PLS \quad (4)$$

As will be understood from the above equations (2) and (4), even when the load pressures of the boom cylinder 12 and the arm cylinder 13 are varied individually, the pressure compensating valves 32A, 34A function so that such variations in the load pressure on one side will not affect operation of the actuator on the other side, and vice versa, whereby the differential pressure across the valve spool 42A for the boom cylinder 12 and the differential pressure across the valve spool 52A for the arm cylinder 13 are held at the same value of ΔPLS. Accordingly, the distribution ratio of the hydraulic fluid delivered from the hydraulic pump 22 and supplied to the boom cylinder 12 and the arm cylinder 13 is kept constant, allowing the hydraulic fluid to be supplied from the hydraulic pump 22 to the boom cylinder 12 and the arm cylinder 13 at the flow rates dependent on respective restricting amounts, i.e., opening areas, of the variable restricting sections 43, 53 or 44, 54 corresponding to the stroke amounts of the valve spools 42A, 52A. As a result, the boom cylinder 12 and the arm cylinder 13 can be simultaneously driven in a stable manner.

Further, in this second embodiment, the check valve 73 is provided in the valve spool 42A of the directional control valve 31A for the boom cylinder 12 and the check valves 74, 76 are provided in the valve spool 52A of the directional control valve 33A for the arm cylinder 13, as with the first embodiment. Therefore, when the directional control valve 31A, 33A is shifted with an intention of lifting the arm or the boom under a condition that the front mechanism is being held in the air and the holding pressure is being produced in the actuator 12, 13, the hydraulic fluid in the load passage 36, 46, 47 is prevented from flowing into the detection line 57A, 58A, the shuttle valve 90, 91 and the control line 61, 62, whereby the boom or the arm is prevented from dropping momentarily at the time of shifting of the directional control valve 31A, 33A. In addition, since the pump regulator 23 is kept from being subjected to the high holding pressure for a moment, the pump regulator 23 can be controlled in a stable manner, which reduces a probability of damaging the equipment thus prolonging its service life.

INDUSTRIAL APPLICABILITY

With the present invention constituted as explained above, when a directional control valve is shifted under a condition that the directional control valve is at its neutral position and a holding pressure acts on an associated actuator, the hydraulic fluid in a load passage can be prevented from leaking into circuit lines, such as a detection line and a control line, and associated equipment under the action of the holding pressure. As a result, the actuator is prevented from operating in the direction not intended, thereby to ensure the safe operation. It is also possible to control the pump regulator in a stable manner to prolong the service life of the equipment.

What is claimed is:

1. A valve apparatus comprising at least one directional control valve having a supply passage communicating with a hydraulic fluid supply source, a pair of load passages communicating with an actuator, a pair of variable restricting sections disposed between said supply passage and said pair of load passages and formed in an axially movable valve spool in such a manner as to continuously vary opening areas from a closed state dependent on an amount of movement of said valve spool, and a first passage located between said pair of variable restricting sections and said pair of load passages; pressure regulating means for holding a differential pressure across said variable restricting sections at a predetermined value; a detection line branched from said first passage for receiving a load pressure produced upon operation of said actuator; and a control line for introducing the load pressure led through said detection line, as a control pressure, to said pressure regulating means, said valve apparatus further comprising:

first flow control means disposed downstream of a point where said detection line is branched from said first passage, for allowing a flow of hydraulic fluid proceeding from said first passage toward the load passage corresponding to one of said variable restricting sections, but blocking off a flow of the hydraulic fluid in a reverse direction when said one variable restricting section is opened; and said pressure regulating means being a pressure compensating valve disposed between said supply passage and said pair of variable restricting sections so that an outlet pressure of said one variable restricting section and a supply pressure from said hydraulic fluid supply source are applied in a valve-opening direction, while an input pressure of said one variable restricting section and said control pressure are applied in a valve-closing direction, and said first flow control means communicating an outlet side of said one variable restricting section with said corresponding load passage directly.

2. A valve apparatus according to claim 1, wherein said first flow control means is incorporated in said valve spool.

3. A valve apparatus according to claim 1, wherein said first flow control means comprises a second passage formed in said valve spool, for communicating a part of said first passage downstream of the branched point of said detection line with the load passage corresponding to one of said variable restricting sections when said one variable restricting section is opened, and a check valve disposed in said second passage for blocking off a flow of the hydraulic fluid from said corresponding load passage toward said first passage.

4. A valve apparatus according to claim 1, further comprising second flow control means disposed downstream of a point where said detection line is branched from said first passage, for allowing a flow of the hydraulic fluid proceeding from said first passage toward the load passage corresponding to the other of said variable restricting sections, but blocking off a flow of the hydraulic fluid in a reverse direction when said other variable restricting section is opened.

5. A valve apparatus according to claim 1, wherein said pressure regulating means is a pressure controller disposed between said pair of variable restricting sections and said first passage so that an outlet pressure of said one variable restricting section is applied in the valve-opening direction, while said control pressure is applied in the valve-closing direction, and said first flow control means communicates the outlet side of said one variable restricting section with said corresponding load passage via said pressure controller.

* * * * *